United States Patent [19]

Burchatz

[11] Patent Number: 4,907,798

[45] Date of Patent: Mar. 13, 1990

[54] MULTI FUNCTION EXERCISE MACHINE

[76] Inventor: Rory J. Burchatz, 7862 Newman Ave. #B., Huntington Beach, Calif. 92647

[21] Appl. No.: 280,674

[22] Filed: Dec. 6, 1988

[51] Int. Cl.[4] ..... A63B 21/00

[52] U.S. Cl. ..... 272/134; 272/117; 272/123; 272/DIG. 4

[58] Field of Search ..... 272/93, 117, 118, 123, 272/134, 144, DIG. 4

[56] References Cited

U.S. PATENT DOCUMENTS

| | | | |
|---|---|---|---|
| 3,306,611 | 2/1967 | Gaul | 272/118 |
| 3,948,513 | 4/1976 | Pfotenhauer | 272/144 |
| 4,257,590 | 3/1981 | Sullivan et al. | 272/123 X |
| 4,634,127 | 1/1987 | Rockwell | 272/118 X |
| 4,635,926 | 1/1987 | Minkow | 272/118 |
| 4,744,560 | 5/1988 | Azari | 272/118 |
| 4,747,595 | 5/1988 | Mabry et al. | 272/118 |
| 4,781,374 | 11/1988 | Lederman | 272/134 |

FOREIGN PATENT DOCUMENTS

| | | | |
|---|---|---|---|
| 271244 | 6/1988 | European Pat. Off. | 272/134 |
| 1444065 | 5/1966 | France | 272/118 |
| 2065482 | 7/1981 | United Kingdom | 272/134 |

*Primary Examiner*—Richard J. Apley
*Assistant Examiner*—Robert W. Bahr
*Attorney, Agent, or Firm*—William L. Chapin

[57] ABSTRACT

An exercise machine facilitating performance by human beings of a wide variety of muscle strengthening and toning exercises comprises a vertically elongated open frame of sufficient height for an average individual to stand inside. Weight trucks holding a selected total weight are vertically rollable on vertical members of the frame, and are coupled via cables running over pulleys on opposite lateral sides of the frame to individual pull handles, a single handlebar, or a single footbar, depending on the exercise being performed. Movement of the cables is resisted by the force of gravity acting on the weight trucks. The exercise machine includes a bench having a front seat section joined by a lateral hinge to a rear back rest section, and is adjustable in height and inclination, or removable entirely from the machine, to permit an individual standing or seated in a wheel chair within the frame to perform various exercises. A leg exercise attachment pivotably attached to front of the frame of the exercise machine is pivotable in a vertical plane. A selected resistance force to pivotable motion of the leg exercise attachment is provided by the weight truck via a cable running over front and rear upper pulleys to diagonal, horizontal and vertical pulleys, respectively, and then to the bottom of the leg exercise attachment.

12 Claims, 8 Drawing Sheets

30
128L
126L
127L
154R
154L
114L
121
108
98
130L
148
140
136
114R
112R
112L
109R
109L
112L
112R
98
109L
109R
108
145
140
136
160
128L
145
50
130L
121
148
126L
114L
136
140
30
112L
112R
96
109R
109L
160

MULTI FUNCTION EXERCISE MACHINE

BACKGROUND OF THE INVENTION

1. Field of the Invention

This invention relates to apparatus for use by individuals in performing physical exercises. More particularly, the invention relates to an exercise machine with which a variety of muscle-toning and strengthening exercises may be performed.

2. Description of Background Art

The importance of physical exercise to the health of an individual is well established. It is known that regular exercise of the proper kind strengthens the cardio-vascular system of a person in addition to strengthening the muscles. Also, regular exercise improves the overall appearance and self-image of an individual, and therefore can have a beneficial effect upon his or her mental health. From a purely economic stand point, employers have found it desirable to encourage the physical fitness of their employees. Resistance to disease, decreased absenteeism and an overall increase in productivity have been observed among employees who keep fit. Regular exercise is an important part of any physical fitness regimen.

Walking, jogging and swimming, to name just a few popular physical activities, are all good exercises. However, because of constraints imposed upon an individual because of limitations on available time, or because of the physical location of his or her workplace, it is often inconvenient for him or her to partake as often as might be desired in beneficial exercises of the type listed above. Also, some exercises such as the type performed by weight lifters or athletes require the utilization of various types of equipment such as weights and/or springs to provide a resistance force to movements of the body. Accordingly, a variety of machines have been devised for use in exercising, the design of some of them permitting a variety of exercises to be performed on the same machine. Representative exercise machines of the type described include the machines disclosed in the patents listed below.

Wilson, U.S. Pat. No. 4,072,309, Feb. 6, 1978, *Multi-Purpose Exercise Device.*

Ceppo, U.S. Pat. No. 4,252,314, Feb. 24, 1981, *Device For Performing Weight-Lifting Exercises.*

Keiser et al., U.S. Pat. No. 4,256,302, Mar. 17, 1981, *Variable Resistance Exercising Device.*

Connelly, U.S. Pat. No. 4,492,375, Jan. 8, 1985, *Resilient Type Exercising Device With Removable Weights.*

Wilson, U.S. Pat. No. 4,407,495, Oct. 4, 1983, *Multi-Purpose Exercise Apparatus.*

Stewart, U.S. Pat. No. 4,564,193, Jan. 14, 1982, *Exercise Device For Lifting Weights.*

Louvet, French Patent No. 2,561,528, Sept. 27, 1985*Modular Athletic Apparatus.*

The multi-function exercise machine according to the present invention was conceived to fill a perceived need for an exercise machine of greater versatility than existing exercise machines.

OBJECTS OF THE INVENTION

An object of the present invention is to provide a machine on which an individual may perform a wide variety of muscle-toning and strengthening exercises.

Another object of the invention is to provide an exercise machine useable by a person who is wheel-chair bound.

Another object of the invention is to provide an exercise machine in which the pull resistance directions are infinitely variable, increasing the variety of muscle tension directions useable by both physically handicapped and able-bodied individuals.

Another object of the invention is to provide a multi-function exercise machine.

Another object of the invention is to provide a multi-function exercise machine which is stable, easily assembled and disassembled, and easily re-configured to perform any one of a large variety of exercises.

Various other objects and advantages of the present inventions, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiment described. I do intend that equivalents, adaptations and modifications reasonably inferrable from the invention described herein be included within the scope of the invention as defined by the appended claims.

SUMMARY OF THE INVENTION

Briefly stated, the present invention comprehends an exercise machine on which an individual can perform a wide variety of exercises. The machine includes a frame having elongated, parallel vertical posts positioned at the four corners of a rectangular, horizontally disposed base frame. A horizontally disposed roof frame fastened congruently to the upper ends of the vertical posts overlies the base frame. Two weight trucks, one each vertically slidable on each of the front two vertical posts, are each connected by a separate flexible cable running up over a separate front pulley attached to the front of the roof frame, and back down over a separate rear, swiveled pulley attached to the rear of the roof frame. The ends of the two cables are connected to pull-handles, or two opposite ends of an elongated handlebar or footbar, depending on the exercise being performed.

A bench having a short front seat section and a longer rear back section, each section being adjustable in height and inclination, is positioned inside the frame. An individual performing exercises may sit or lie on the bench, depending upon the type of exercise being performed. Alternatively, the bench can easily be removed, permitting an individual in a wheelchair to position himself inside the frame. Various auxiliary pulleys may be optionally used, with the pull cables attached to weight trucks running over the auxiliary pulleys to afford a very wide variety of tension directions, permitting a substantially infinite variety of muscle toning exercises.

DETAILED DESCRIPTION OF THE INVENTION

Referring now to FIGS. 1 through 6, a multi-function exercise machine according to the present invention is shown.

Figures 1, 2:
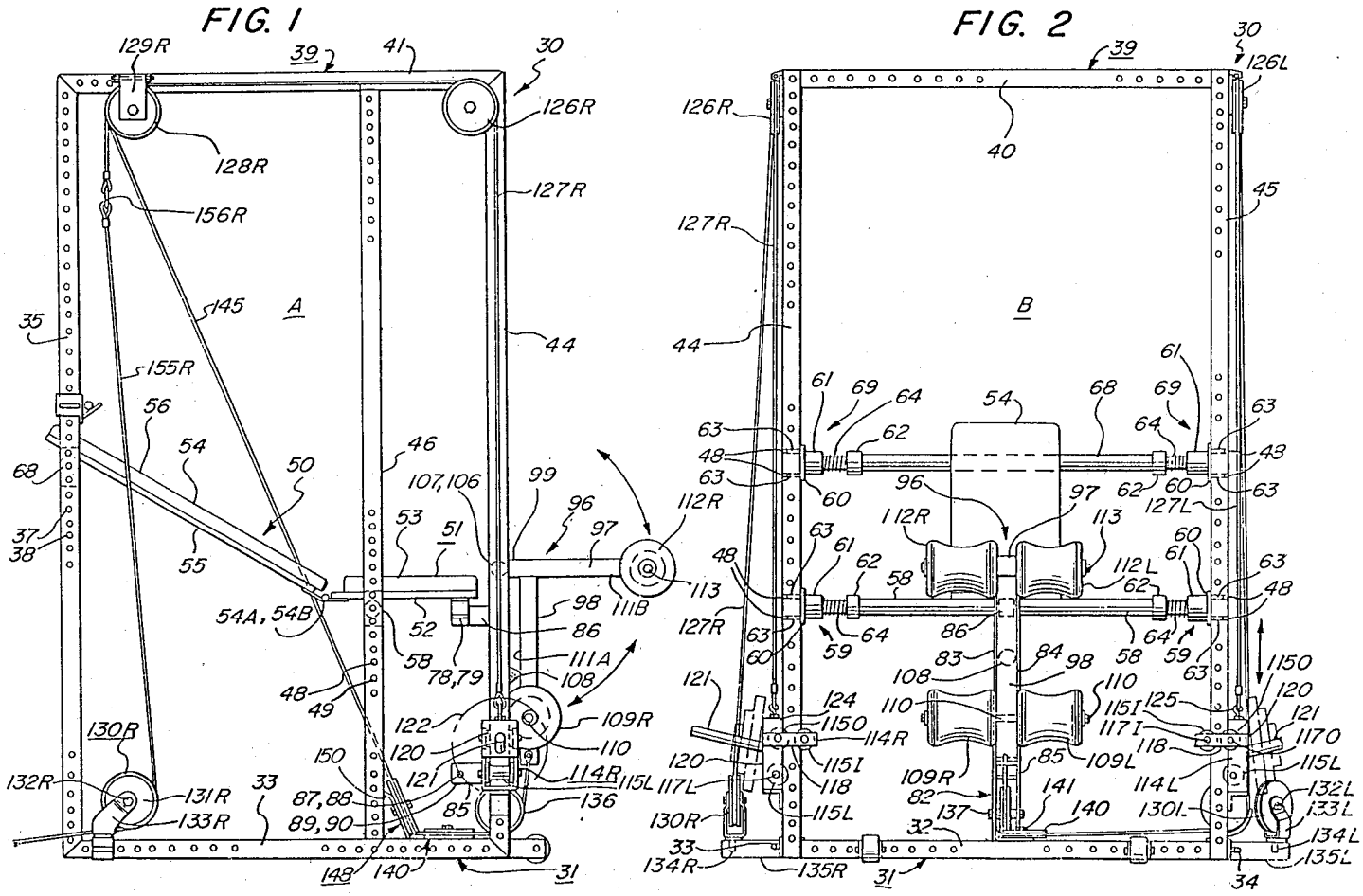
FIG. 1 is a right side elevation view of a multi-function exercise machine according to the present invention.
FIG. 2 is a front elevation view of the machine of FIG. 1.
Figure 3:
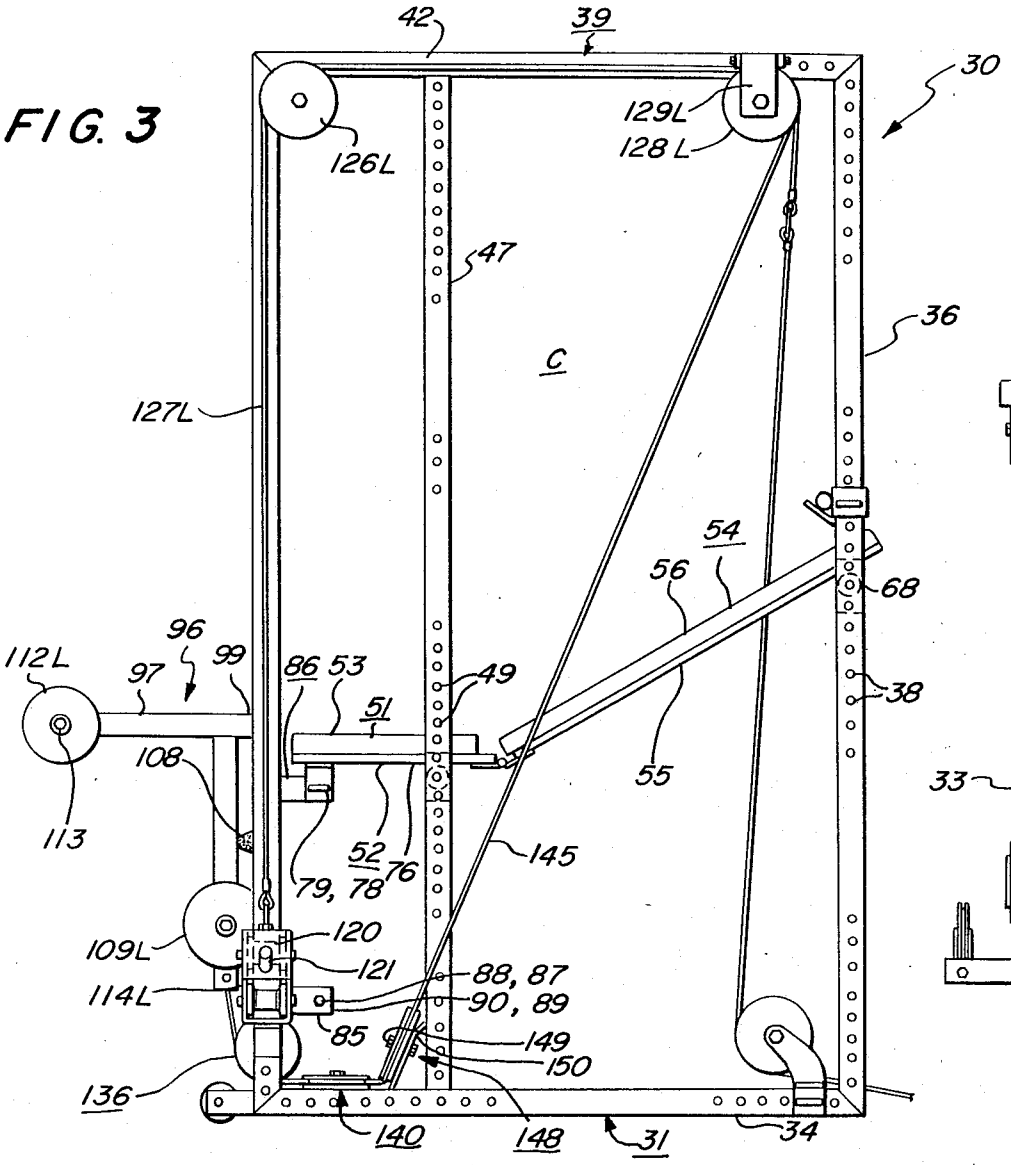
FIG. 3 is a left side elevation view of the machine of FIG. 1.
Figure 4:
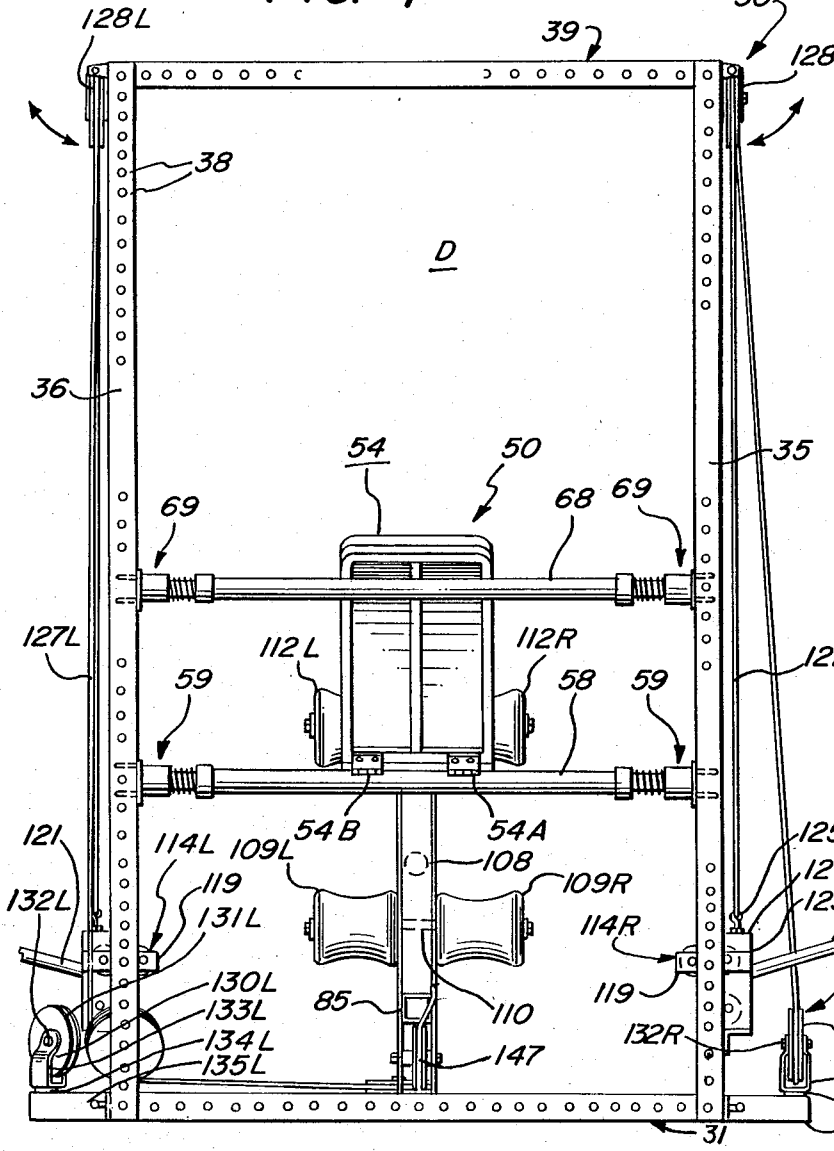
FIG. 4 is a rear elevation view of the machine of FIG. 1.

As may be seen best by referring to the side elevation views of FIGS. 1 and 3, the front elevation view of FIG. 2, and the rear elevation view of FIG. 4, the multi-function exercise machine 30 according to the present invention has an open frame construction forming four vertically elongated, rectangular vertical wall planes. As may be seen best by referring to the upper plan view of FIG. 5, the vertical walls forming part of the framework of the machine 30 are positioned relative to one another so as to form an approximately square plan view, vertically elongated structure.

The base 31 of machine 30 is fabricated from lengths of rigid steel square cross-section tubing welded or bolted together. As may be seen best by referring to FIG. 6, the base 31 includes a front member 32, and parallel equal length right and left side members 33 and 34 which extend perpendicularly rearwards from the right and left ends, respectively, of front base member 32. Thus, as may be seen best by referring to the lower plan view of FIG. 6, the base 31 of machine 30 has the shape of a square with the rear leg thereof removed to form a U-shaped structure with a front or lower leg 32, and right and left side legs 33 and 34, respectively.

As may be seen best by referring to FIGS. 1, 2 and 3, the framework of machine 30 includes right and left parallel elongated vertical rear post-shaped frame members 35 and 36, respectively. Rear vertical frame members 35 and 36 are made of lengths of tubular steel or angle iron stock. The frame members preferably have a square cross-section, and contain over substantially their entire lengths a plurality of holes 37 and 38 respectively, disposed at regular longitudinal intervals and passing through both parallel left and right side walls of the frame members. The vertical frame members 35 and 36 are bolted or welded at their lower ends to the rear ends of right and left base side members 33 and 34, respectively. The upper ends of right and left rear vertical frame members 35 and 36 are welded or bolted to the rear corners of a rectangular roof frame 39.

Roof frame 39 is fabricated from lengths of rigid steel square cross-section tubing welded or bolted together to form an approximately square frame of the same size and shape as base frame 31. Thus, as may be seen best by referring to FIG. 5, roof frame 39 has a front member 40, a right side member 41 extending perpendicularly backwards from the right end of the front member, and a left side member 42 extending perpendicularly backwards from the left end of the front member. In addition to the three members of the roof frame 39 corresponding to and overlying in parallel alignment with corresponding members of the base frame 31, the roof frame 39 also has a rear frame member 43 connected between the rear ends of right and left roof frame side members 41 and 42, respectively, to form a complete rectangle.

The framework of exercise machine 30 includes right and left parallel vertical front frame members 44 and 45 respectively. Front vertical frame members 44 and 45 are made of lengths of tubular steel or angle iron stock, and are bolted or welded at their upper and lower ends to the roof frame 39 and base frame 31, respectively, at the right and left corners, respectively of the roof and base frames.

As shown in FIGS. 1 and 3, the exercise machine 30 includes right and left intermediate vertical frame members 46 and 47, respectively. The intermediate vertical frame members 46 and 47 are made from lengths of tubular steel or angle iron stock. They are located parallel to and rearward of the front vertical frame members, at a distance of approximately one-quarter the distance between the front and rear vertical frame members.

Intermediate vertical frame members 46 and 47 contain over substantially their entire lengths a plurality of holes 48 and 49, respectively, disposed at regular longitudinal intervals and passing through both left and right parallel side walls of the frame members.

As shown in FIG. 1, the exercise machine 30 includes a bench section 50. The bench section 50 includes a generally flat, nearly square plan view front seat section 51. The seat section 51 has a thin rigid base, preferably made of wood or similar rigid material. A seat cushion section 53 made of vinyl or similar upholstery material filled with foam rubber, polyurethane foam, or fibers to produce a resilient, padded seating surface is attached to the upper surface of the base 52 of front seat section 51.

Bench section 50 includes a longitudinally elongated rear back rest section 54 of approximately rectangular shape. The back rest section 54 is similar in construction to front seat section 51, having a rigid base section 55 and a padded cushion 56 attached to the upper surface of the base section.

Figure 6:
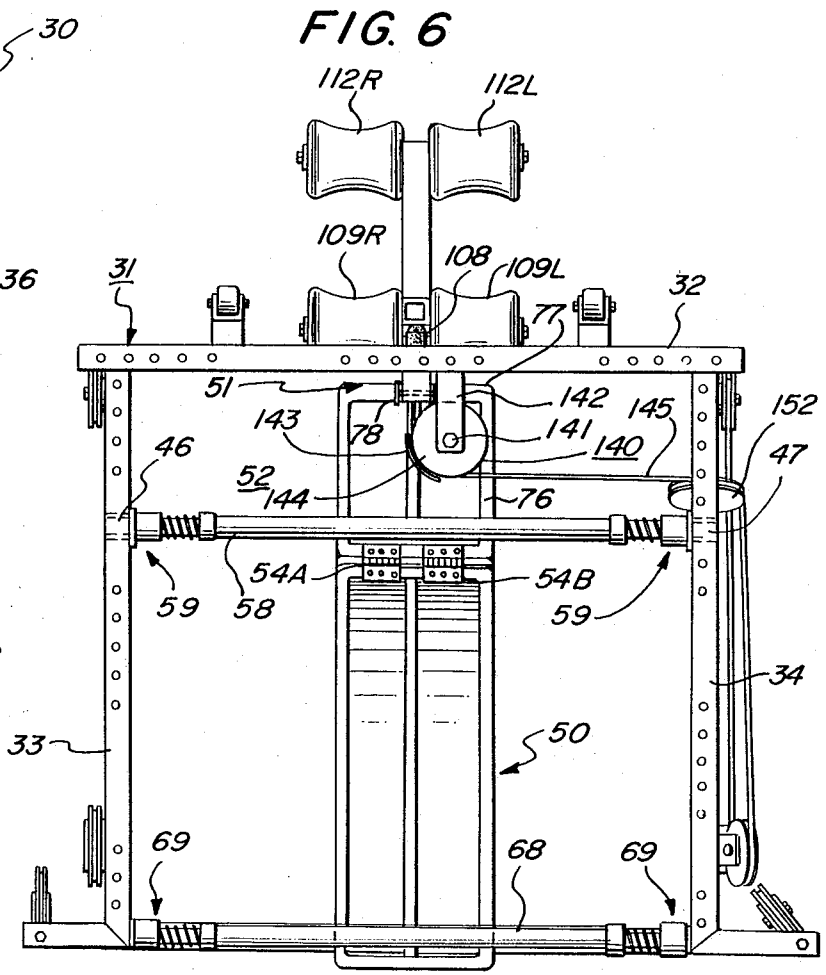
FIG. 6 is a lower plan view of the machine of FIG. 1.

As may be seen best by referring to FIGS. 1, 4 and 6, the front seat section 51 and the back seat section 54 of the bench section 50 are joined together at their rear and front lateral edges, respectively, by a pair of hinge type joints 54A and 54B. Thus, the front seat section 51 and the back rest section 54 are free to pivot in a vertical plane with respect to one another, over a substantially large portion of a circular arc.

As shown in FIGS. 2 and 6, the underside of front seat section 51 has attached to it a laterally disposed tubular support member 58. As may be seen best by referring to FIG. 6, an attachment fitting 59 is attached to each end of the tubular support member 58, for releasably attaching the tubular support member between right and left intermediate vertical frame members 46 and 47, as will now be described.

The attachment fitting 59 comprises a flat rectangular plate 60 with a hollow cylindrical boss 61 projecting perpendicularly outwards from the plate. The inner diameter of the boss 61 is of the proper size to snugly receive an end of tubular support member 58. The plate 60 of attachment fitting 59 includes pins projecting outward from the plate, vertically aligned with the center of boss 61. Pins 63 are longitudinally slidable through holes 48 or 49 through right and left intermediate vertical frame members, respectively. Plate 60 and pins 63 are normally urged into an outwardly projecting position by a compression spring 64 located between boss 61 and a similar boss 62 formed on the end of tubular support member 58. The diameter of the pin 63 is of the appropriate size to slide snugly within a selected one of the plurality of holes 48 or 49 through right and left intermediate vertical perforated frame members 46 and 47, respectively. Withdrawing pins 63 from selected holes through a perforated intermediate vertical frame member 46 or 47 permits moving the tubular support member 58 vertically, and reinserting the pins into a desired hole. Thus, by this means, the tubular support member 58 and therefore the front seat section 51 of bench section 50 may be positioned at any vertical height desired along perforated intermediate vertical frame members 46 and 47.

The back rest section 54 of bench section 50 has an exactly similar construction to the construction described above for the front seat section, permitting positioning the back rest section at any vertical height desired along perforated rear vertical frame members 35 and 36. Thus, the back rest section 54 has attached to its underside a tubular support member 68, each end of which has an attachment fitting 69 comprising a flat plate 70, hollow boss 71, boss 72 on tubular support member 68, engagement pins 73 and spring 74.

The exercise machine 30 includes a structure for supporting the front portion of front seat section 51 of bench section 50. This support structure also supports a leg exercise attachment. Both the support structure and leg exercise attachment will now be described.

Referring now primarily to FIGS. 1, 3 and 6, it may be seen that the base 52 of front seat section 51 is supported by a flat, generally rectangular frame 76 made of welded steel tubes. Welded to the bottom of the front frame member 77 and extending perpendicularly downwards therefrom are flat right and left clevis plates 78 and 79, respectively. Clevis plates 78 and 79 are positioned equidistant from and on opposite sides of the vertical center plane of frame member 77 and base 52 of front seat section 51. A pair of registered holes 80 and 81 having a common laterally disposed center line are provided through the thickness dimension of right and left clevis plates 78 and 79, respectively, for a purpose to be described later.

Figure 17:
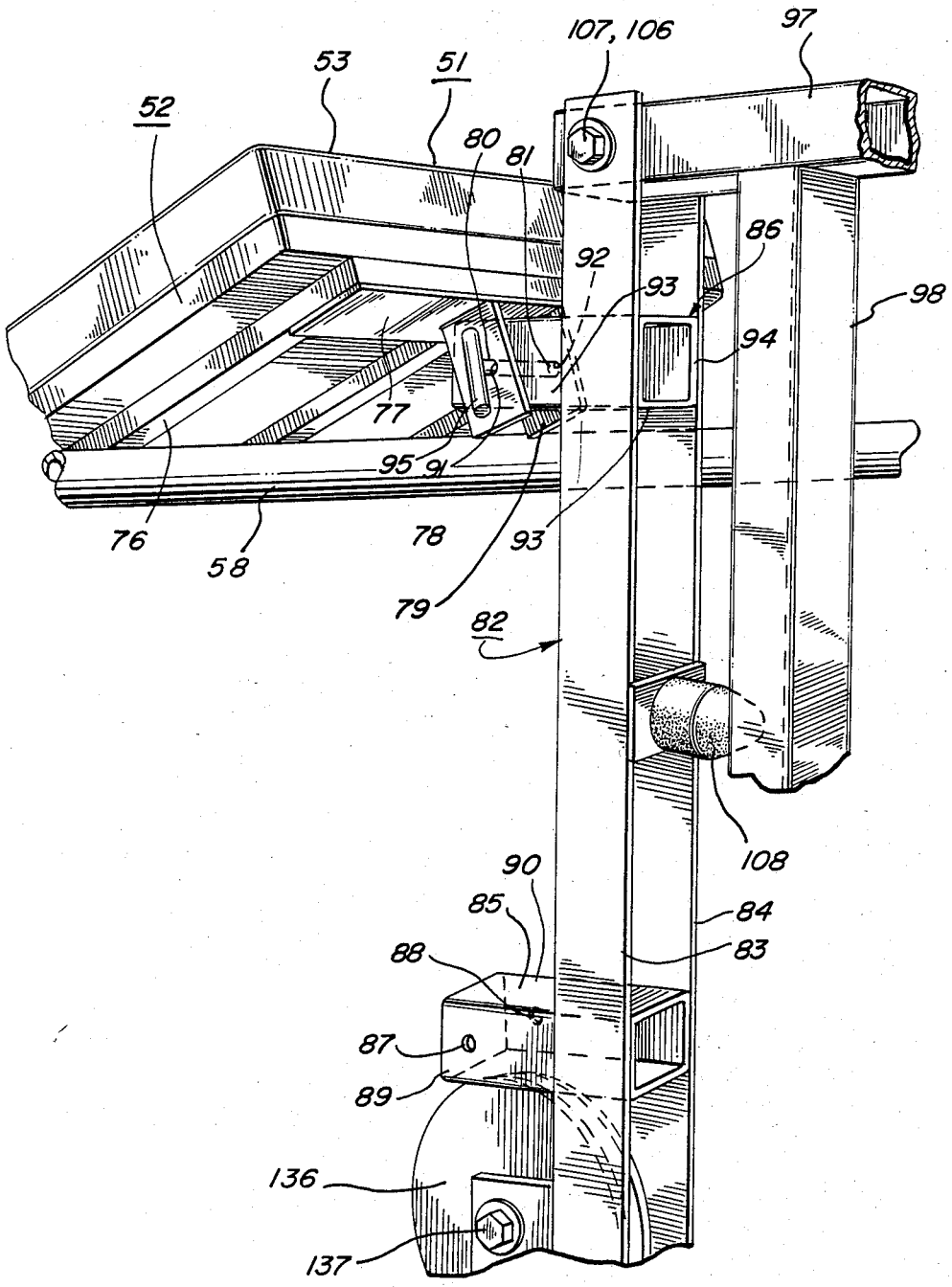
FIG. 17 is a fragmentary view of part of the machine of FIG. 1, on an enlarged scale.

As may be seen best by referring to FIG. 17, the support structure for front seat section 51 includes a short vertical seat support column 82 extending vertically upwards from the upper surface of front member 32 of base frame 31, midway between the lateral sides of the base frame. Seat support column 82 includes parallel right and left, vertically elongated rectangular side plates 83 and 84, respectively. Side plates 83 and 84 are welded at their bottom horizontal edges to the upper surface of front base frame member 32. The side plates 83 and 84 are held in spaced apart parallel alignment by a pair of short, elongated square cross-section steel tubes positioned between the side plates and welded thereto. The longitudinal center lines of the tubes are disposed in a fore and aft direction, parallel to the upper surface of front member 32 of base frame 31. Thus, a lower tube 85 extends horizontally rearward from between side plates 83 and 84 of seat support column 82, a slight distance above the upper surface of front base frame member 32. A substantially identical upper tube 86 in vertical alignment with lower tube 85 extends parallel to the lower tube, rearward from between side plates 83 and 84. The upper horizontal wall of upper tube 86 is located a slight distance below the upper horizontal edges of side plates 83 and 84.

A pair of registered holes 87 and 88 having a common laterally disposed center line are provided through right and left side walls 89 and 90, respectively, of lower tube 85, near the rear vertical edges of the tube and near the horizontal mid-plane of the tube. Similarly, registered holes 91 and 92 are provided through the right and left side walls 93 and 94, respectively of upper tube 86.

Figure 5:
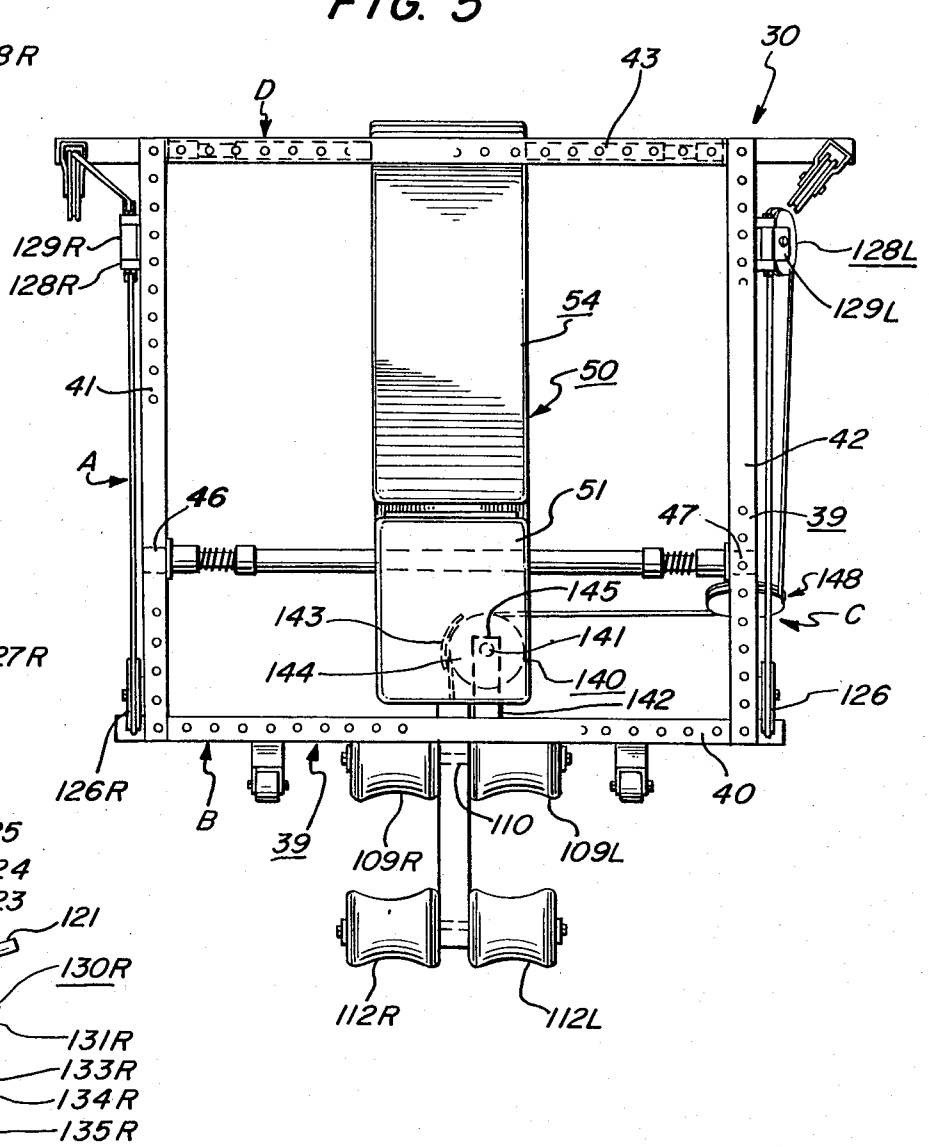
FIG. 5 is an upper plan view of the machine of FIG. 1.

The registered holes in lower and upper tubes 85 and 86, respectively, are provided so that the right and left clevis plates 78 and 79 of the front seat support base frame 76 may be removably pinned to the selected one of the lower or upper tubes. Thus, as shown in FIG. 5, upper tube 86 is positioned between clevis plates 78 and 79. In this position, the clevis plates 78 and 79, and therefore base frame 76 of seat support section 52, are held in a vertically pivotable relationship with respect to upper tube 86 by means of a laterally disposed front seat support pin 95 which passes through right clevis plate hole 78, right upper tube hole 91, left upper tube hole 92, and out through left clevis plate hole 79.

The front vertical seat support column 82 also supports a leg exercise attachment as will now be described.

Referring now primarily to FIGS. 1, 2, 3 and 9, a leg exercise attachment 96 having the approximate shape of an inverted "L" is shown pivotably attached to the upper end of vertical seat support column 82.

The leg exercise attachment 96 includes an elongated upper horizontal beam member 97, preferably fabricated from a length of square cross-section steel tubing. An elongated vertical column member 98, preferably made of the same type of tubular stock as beam member 97, is welded to the lower surface of the beam member, and extends perpendicularly downwards therefrom. The rear vertical face of the vertical column member 98 is spaced some distance forwards from the rear vertical end plane of the beam member 97. Thus, the appearance of the structure comprising beam 97 and column 98 is that of an inverted "L", with the horizontal "leg" of the "L" (beam 97) extending slightly beyond the vertical "leg" (column 98) to form an appendage or extension 99.

The rear extension end 99 of beam 97 of leg exercise attachment 96 is pivotably fastened between the upper ends of right and left side walls 83 and 84, respectively, of front vertical seat support column 82. The means for fastening beam 97 to front vertical seat support column 82 includes registered holes 100 and 101 through the right and left side walls 83 and 84, respectively, of the vertical seat support column, near the upper ends of the column. The fastening means also includes registered holes 102 and 103 through the right and left sides 104 and 105, respectively, of the horizontal beam 97 of the leg exercise attachment 96, located near the rear face of the beam. Each pair of holes has a common, laterally disposed center line. A bolt 106 passing through each of the four registered holes and secured by a nut 107 permits the beam 97 to pivot in a vertical plane with respect to vertical seat support column 82.

Figure 8:
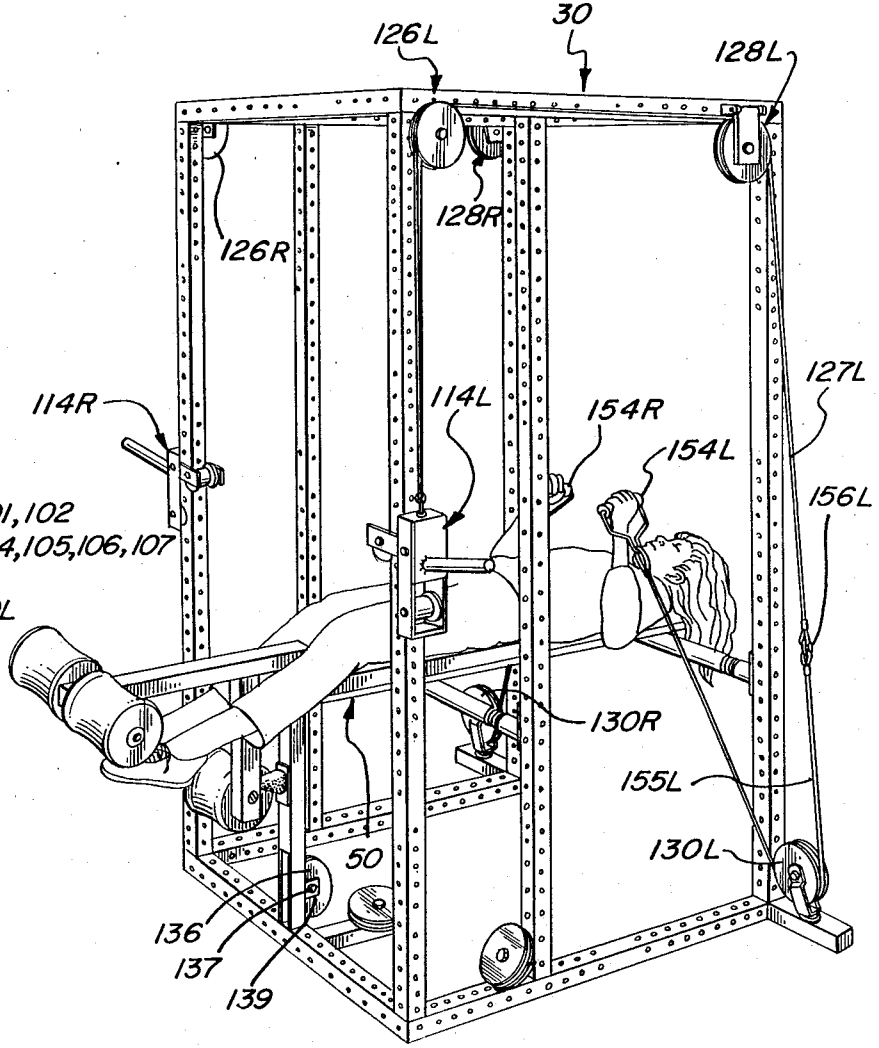
FIG. 8 is a side perspective view of the machine of FIG. 1 showing a person performing a reclining crossover fly exercise.

As may be seen best by referring to FIGS. 1 and 8, the weight of leg exercise attachment 96 exerts a downward moment about the axis of bolt 106 which would normally cause the attachment to rotate until vertical column member 98 of the attachment contacted vertical seat support column 82. To prevent column member 98 from rigidly impacting the vertical seat support column 82 during the course of exercises to be described later, a resilient bumper 108 is fastened to the support column. Bumper 108 is fabricated from hard rubber or similar resilient material and has a generally cylindrical shape with a conical tip. The bumper 108 is fastened to the vertical support column 82 with the longitudinal axis of the bumper extending horizontally forward from approximately the vertical mid-plane of the support column, so that contact with the tip of the bumper will resiliently arrest the clockwise downward motion of the vertical column member 98 of leg exercise attachment 96.

The leg exercise attachment 96 includes a pair of identical, symmetrically disposed lower cushions 109R and 109L on either side of the lower end of the vertical column member, for engagement by the instep or rear portion of the ankles of a person using the machine. The cushions 109R and 109L are shaped like elongated cylinders which are circularly symmetric along their entire length, but which have a cross-sectional diameter that is at a minimum at the longitudinal center plane of the cylinder. The outer wall surface of the cylinder tapers outwards symmetrically to a larger diameter at the opposite longitudinal ends of the cylinder, giving the cushion a shape somewhat like that of an hourglass.

The cushions 109R and 109L are coaxially mounted on a horizontally disposed shaft 110 which is fastened to the rear wall 111 of vertical column member 98 of leg exercise attachment 96, near the bottom face of the vertical column member.

A pair of upper cushions 112R and 112L identical to cushion 109 is mounted symmetrically on either side of the upper horizontal beam member 97 of leg exercise attachment 96. Cushions 112R and 112L are coaxially mounted on a horizontally disposed shaft 113 which is fastened to the lower surface wall of the upper horizontal beam member 97 of attachment 96, near the forward end plane of the beam member.

The major elements of the exercise machine 30 which have been described above include the frame, bench, and leg exercise attachments, which elements have been described above. Additional elements of the machine include weight trucks, cables and pulleys. A description of those latter elements follows, along with a description of how each of the elements operatively interacts with one another.

Referring now to FIGS. 1 through 4, the exercise machine 30 according to the present invention is shown to include a pair of wheeled carriages or weight trucks 114R and 114L, one each mounted on the right and left front vertical frame members 44 and 45, respectively. Each weight truck 114R and 114L has a pair of identical spool-shaped inner and outer wheels 115I and 1150, each having a central groove adapted to ride along opposite lateral sides of a vertical frame member 44 or 45, in a manner similar to the engagement of a trolley track by the wheels of a trolley. Wheels 115 are rotatably supported on a pair of horizontal shafts 117I and 117O, one each on either side of a vertical frame member 44 or 45. The wheel support shafts 117I and 117O are disposed parallel to the sides of the side of the machine 30. The shafts are oriented in a front-to-rear direction. The front and rear ends of shafts 117 are supported by a pair of rectangular plates; a front plate 118 and a rear plate 119. Thus, plates 118 and 119, wheel support shafts 117 and wheels 115 form a structure which surrounds a front vertical frame member 44 or 45, the grooves 116 in each wheel fitting conformally over the opposite lateral edges of a vertical frame member, thereby permitting the structure to move up and down freely on a front vertical frame member. A third wheel 115L is supported on a third shaft 117L below and parallel to outer shaft 117O.

Joined to the outer lateral edges of front and rear wheel shaft support plates 118 and 119, respectively, is a vertically disposed spindle support plate 120 having a laterally outwardly extending cylindrical weight support spindle 121. Weight support spindle 121 is adapted to coaxially receive the central bore of one or more disc-shaped weights 122 of the type commonly used with weight lifting equipment, and is angled upward slightly, at an angle of about 5 degrees, for example, to minimize the possibility of weights inadvertently sliding off of the spindles.

The spindle support plate 120 is fastened to a bracket plate 123 positioned laterally outside of a front vertical frame member 44 or 45. The bracket plate 123 includes an upper horizontal bar 124, to which a vertically oriented eye bolt 125 is attached.

A first upper right front pulley 126R whose axle is laterally disposed, i.e., is oriented parallel to the front of the machine 30, is fastened to the frame of the machine near the junction of the front member 40 of rectangular roof frame 39 with right side member 41 of the roof frame. A second, identical upper left front pulley 126L is fastened at the junction of front member 40 of roof frame 39 with the left side member 42 of the roof frame, in a mirror image position to the upper right front pulley 126R. Upper right and left front pulleys 126R and 126L are provided for right and left cables 127R and 127L, respectively. The cables are fastened to the eye bolts 125R and 125L on weight trucks 114R and 114L and ride up, over and backwards in grooves of the pulleys. The pulleys 126R and 126L are fastened to roof frame 39 with their axles colinear, and disposed parallel to the front member 40 of the roof frame.

The exercise machine 30 includes a first right rear upper pulley 128R for receiving cable 127R. Pulley 128R is attached to the frame of the machine near the junction of the right side member 41 and the rear frame member 43 of roof frame 39 The axle of right rear upper pulley 128R is rotatably journalled in an inverted U-shaped support structure 129R. This support structure is so fastened to the roof frame 39 as to permit the support structure to swivel in any plane relative to the roof frame.

An identical left rear upper pulley 128L and support 129L are attached to the left side of the roof frame 39, in a mirror image position relative to the right pulley 128R and support 129R.

As may be seen best by referring to FIGS. 1 and 2, the exercise machine 30 includes a lower right rear pulley 130R, which is also capable of swiveling. Lower right swiveling pulley 130R includes a vertically disposed wheel 131R, and a horizontally disposed axle 132R. Axle 132R is journalled in a U-shaped clevis 133R. The clevis 133R is journalled on a vertically disposed shaft 134R, which is mounted to the upper surface of a short, laterally disposed outrigger member 135R, which lies in the plane of right side member 33 of base 31, and extends perpendicularly outwards from its rear lateral surface. Outrigger member 135R is preferably fabricated from square cross-section steel tubing. Thus supported, axle 132R of pulley 130R may be rotated to any angular position around the axis of the vertically disposed clevis support shaft 134R.

In an exactly similar construction, a lower left swiveling pulley 130L, wheel 131L, horizontally disposed axle 132L, U-shaped clevis 133L, and vertically disposed clevis support shaft 134L are supported by a left outrigger member 135L extending perpendicularly outwards from the left side member 34 of base 31.

As may be seen best by referring to FIGS. 1 through 6, the exercise machine 30 includes two other pulleys mounted near the center of front member 32 of base 31, as will now be described.

A vertically disposed pulley 136 is mounted between right and left side plates 83 and 84 of short vertical seat support column 82, just below the lower horizontal seat support tube 85. The axle 137 of pulley 136 is fastened at opposite ends to short rectangular right and left support plates 138 and 139, which extend horizontally backwards from the rear vertical edges of right and left side plates 83 and 84 of support column 82, and are essentially coplaner with the side plates.

A horizontally disposed pulley 140 with a vertically disposed axle 141, is mounted to a short support bar 142 which extends perpendicularly backwards from the front member 32 of base 31, just slightly to the left of vertical seat support column 82. Also mounted to support bar 142 is an arcuate sector bar 143 which is coaxial with the outer right hand surface of pulley wheel 144, and spaced nearly in contact therewith. The function of sector bar is to maintain a cable 145 extending forward through the groove 146 of pulley wheel 144 within the groove as the cable extends forward and upwards into the groove 147 in vertically disposed pulley 136.

As shown in FIGS. 1 through 5, the exercise machine 30 also has a diagonal pulley 148 mounted to the left intermediate vertical frame member 47 near the junction of that frame member with left side base member 34 of base 31. As may be seen best by referring to FIG. 3, the axle 149 of diagonal pulley 148 is fastened to a plate 150 which is fastened to left intermediate vertical frame member 47 and extends diagonally downwards towards left side base member 34. Thus, the axle 149 of diagonal pulley 148 lies in the plane of the left vertical side wall of the exercise machine, and is diagonally upwardly inclined with respect to left side base member 34. An arcuate sector bar 151 coaxial with the outer surface of pulley wheel 152 of pulley 148 is fastened to the pulley mounting plate 150. Arcuate sector bar 151 is spaced closely with respect to the outer surface of pulley wheel 152, and is so positioned as to maintain a cable within the groove 153 of the pulley wheel.

Various arrangements of stringing cables through pulleys of exercise machine 30, and the method of positioning the elements of the machine for the various functions which the machine may perform, will now be described.

FIGS. 7 through 16 illustrate some of the many possible configurations of the versatile exercise machine 30 according to the present invention. The exercise machine 30 may be quickly and easily changed into any of these configurations by the user to adapt the machine to perform a particular desired exercise.

Figure 7:
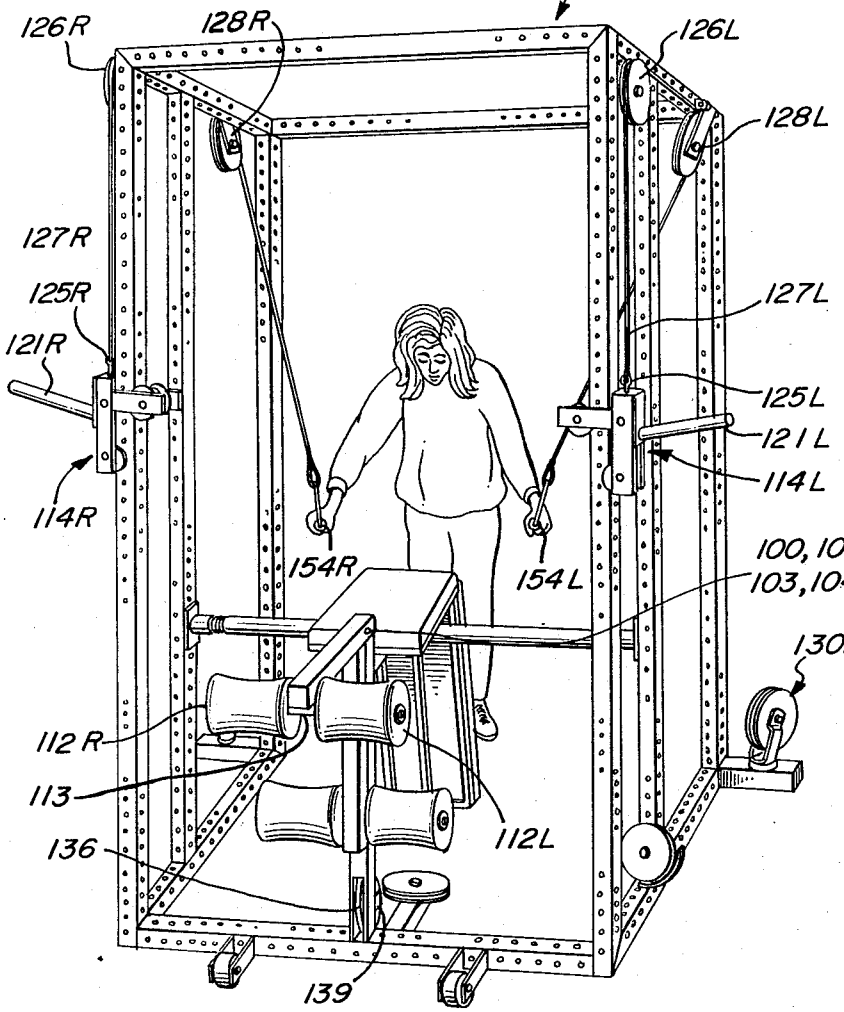
FIG. 7 is a front perspective view of the machine of FIG. 1 in a second configuration, and showing a person performing a standing crossover fly exercise.

FIG. 7 shows a person performing a standing cross-over fly exercise with machine 30. For this exercise, right cable 127R is attached to eye bolt 125R of right weight truck 114R, a desired number of weights having been placed on spindle 121R of the weight truck. The cable 127R is then strung up over upper right front pulley 126R, backwards in a horizontal plane over upper right rear pulley 128R, and downwards over the latter pulley. A hand grip 154R is attached to lower free end of the cable. In an exactly similar fashion, a left cable 127L is attached to eye bolt 125L of left weight truck 114L, strung over upper left front pulley 126L, over upper left rear pulley 128L, and terminates in hand grip 154L. Thus positioned, the right and left hand grips 154R and 154L may be grasped by the person performing the exercise, with the arms in a generally downwardly and outwardly direction. The hands and arms are then repetively brought across the chest in a cross-over motion, and returned to the starting position.

In moving the arms inward, cables 127R and 127L are caused to lift weight trucks 114R and 114L, providing a resistance force to the motion of the arms. The magnitude of this resistance is readily selectable by the user of the exercise machine to be the optimum value for achieving desired strengthening and toning of the arm and pectoral muscles.

FIG. 8 illustrates a person performing a reclining cross-over fly exercise with exercise machine 30. In this exercise, the person reclines back down on bench section 50, rather than standing as shown in FIG. 7. For the exercise shown in FIG. 8, the portions of cables 127R and 127L connected to hand grips 154R and 154L are lengthened by inserting additional lengths of adapter cables 155R and 155L having quick connecting snap fasteners 156R and 156L between the hand grips and the ends of cables 127R and 127L. Thus lengthened, the cables are then looped down over swiveling lower outrigger pulleys 130R and 130L, respectively, running to the hands of the person performing the exercise. Thus, with this configuration of cables 127R–155R and 127L–155L, the arms may be moved upward and crosswise over the chest of the reclining exerciser.

Figures 9, 10, 14:
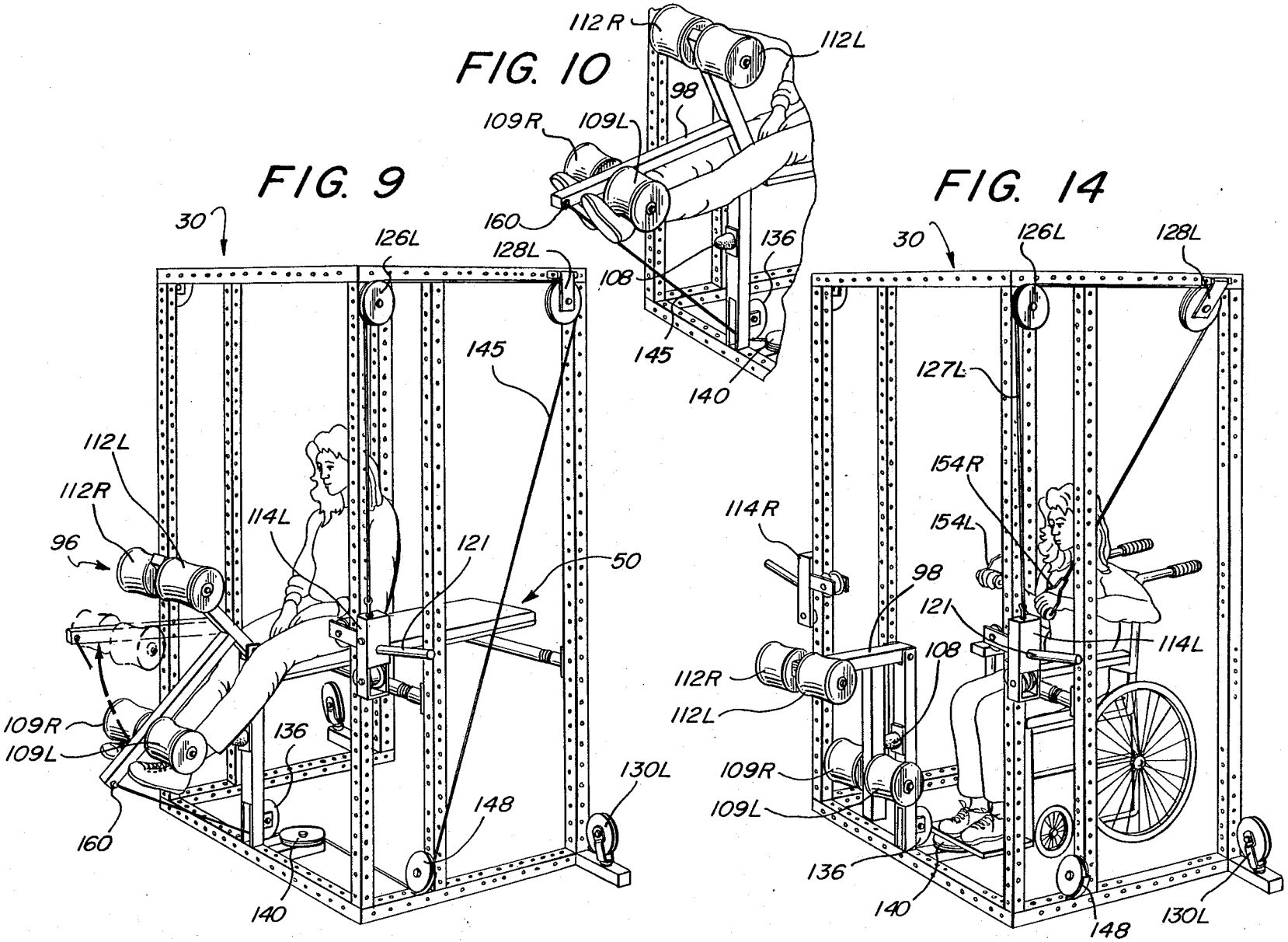
FIG. 9 is a font oblique perspective view of the machine of FIG. 1 in a third configuration and showing a person beginning a leg extension exercise.
FIG. 10 is a fragmentary front oblique perspective view similar to that of FIG. 9, but showing the person having nearly completed the upward movement of the legs required by the exercise.
FIG. 14 is a front perspective view of the machine of FIG. 1 in a seventh configuration, with the seat portion of the machine removed and showing a person in a wheelchair performing forming a seated crossover fly exercise.

FIGS. 9 and 10 show a person performing a leg extension exercise using the exercise machine 30. With machine 30 configured to perform this exercise, only the left weight truck 114L is used. Left cable 127L is attached to eyebolt 125L of left weight truck 114L, is strung up over upper left front pulley 126L, backwards in a horizontal plane over upper left rear pulley 128L, and downwards over the latter pulley. From pulley 128L, left cable 127L connects to cable 145 and extends downwards and forwards in a vertical plane, extending diagonally underneath diagonal pulley 148. From the underside of diagonal pulley 148, left cable 145 extends laterally inwards in a horizontal plane to loop around front horizontal pulley 140 and underneath front vertical pulley 136 to connect to eyebolt 110 at the lower end of vertical column member 98 of leg exercise attachment 96.

As shown in FIGS. 9 and 10, a person performing a leg extension exercise with the machine configured as shown in those Figures and described above sits on bench section 50, and engages the lower surfaces of lower cushions 109R and 109L with the insteps of the right and left feet, respectively. The legs are then pivoted upwards in a vertical plane, as shown in FIG. 10, causing vertical column member 98 to also pivot vertically upwards. The upward movement of the lower end of column member 98 causes cable 145 to be pulled in an upwards direction. This causes weight truck 114L to be raised, through the cooperative action of the cable 127L and the pulleys described above. By placing a selected number of weights 122R on spindle 121R of weight truck 114L, a desired resistance force may be imposed on the upward movement of the legs.

Figure 11:
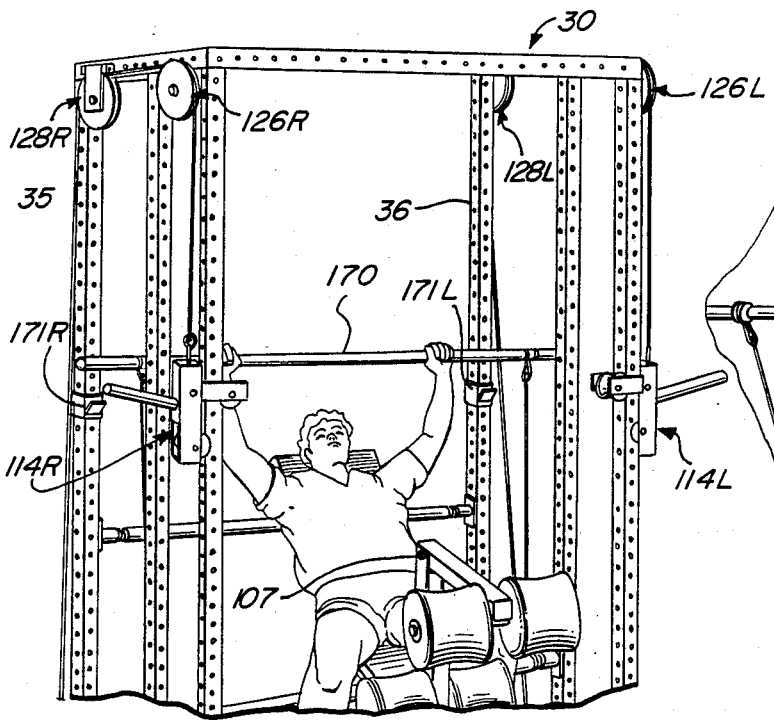
FIG. 11 is a fragmentary oblique front perspective view of the machine of FIG. 1 in a fourth configuration, showing a person performing a bench press exercise.

FIG. 11 illustrates a person performing a bench press exercise with machine 30. For this exercise, the cables, weight trucks, and pulleys are configured substantially as shown on FIG. 8 and described above. In the case of the bench press exercise however, the ends of cables 127R and 127L, rather than being connected to hand grips 154R and 154L, are connected to opposite lateral ends of a handlebar 170. In performing the bench press exercise, a person grasps handlebar 170 and pushes upwards on the bar. Upward movement of handlebar 170 is resisted by the force of gravity on weight trucks 114R and 114L, which may be fitted with a desired number of weights 122R and 122L. Upon completion of a bench press exercise as described above, handlebar 170 may be stowed by placing opposite lateral ends of the handlebar downward into the grooves of V-shaped handlebar hanger clips 171R and 171L fastened to right and left rear vertical frame members 35 and 36, respectively.

Figure 12:
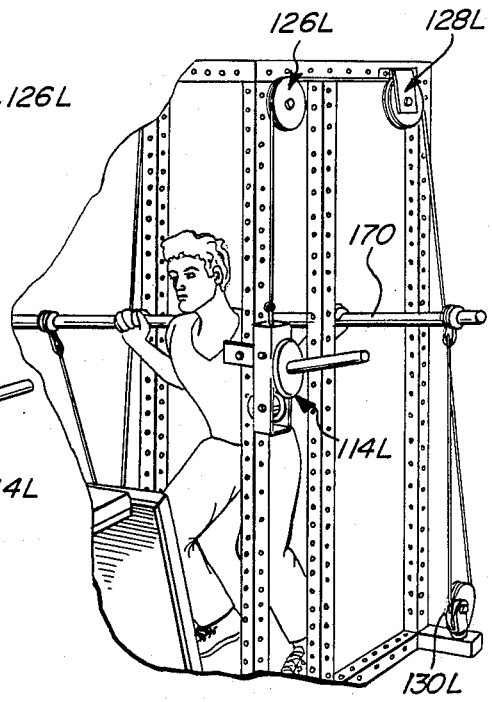
FIG. 12 is a fragmentary oblique side perspective view of the machine of FIG. 1 in a fifth configuration showing a person performing a squat exercise.

FIG. 12 shows a person performing a squat exercise using machine 30. For this exercise, the cables, weight trucks, and pulleys are configured substantially the same as for the bench press exercise as shown in FIG. 11 and described above. However, for the squat exercise, the back rest section 54 of bench section 50 is folded forward and down to provide a space for the person to stand in.

Figure 13:
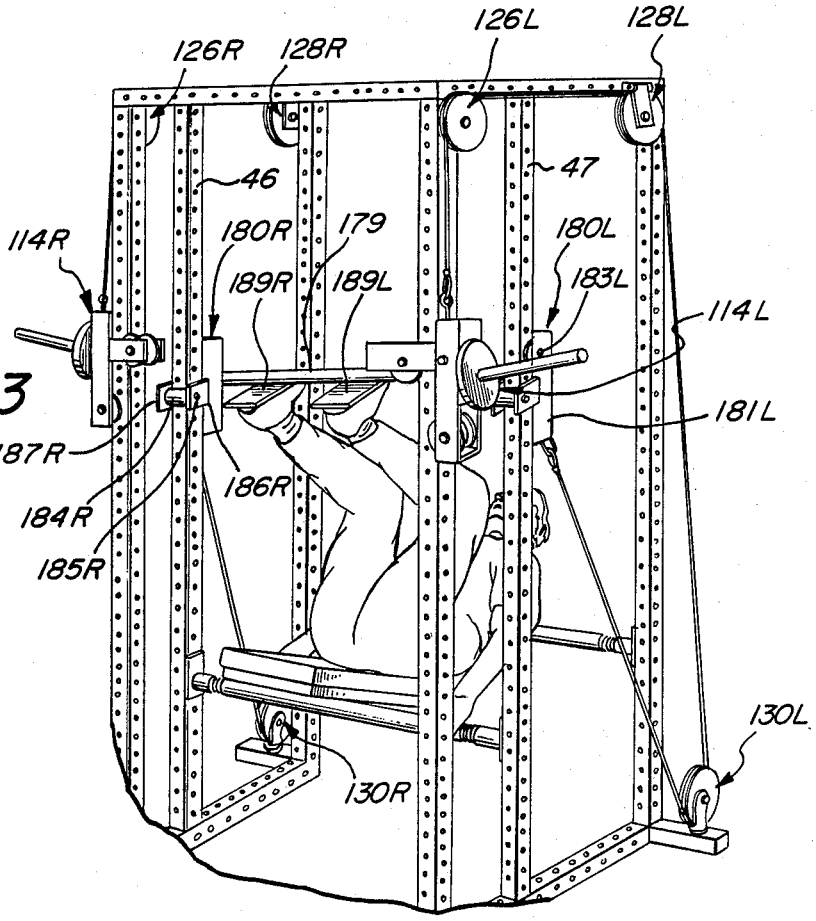
FIG. 13 is a fragmentary front oblique perspective view of the machine of FIG. 1 in a sixth configuration, showing a person performing a leg press exercise.

FIG. 13 shows the configuration of machine 30 for performing a leg press exercise. For this exercise, an elongated foot bar 179 is fastened at opposite lateral ends to carriages 180R and 180L. Carriages 180R and 180L are vertically rollably mounted on right and left intermediate vertical frame members 46 and 47, respectively. Carriage 180R includes a U-shaped vertically elongated channel 181R having a horizontally disposed spool 182R rotatably mounted on an axle 183R extending through opposite parallel side walls of the channel. Spool 182R rides rollably on the rear vertical surface of right intermediate vertical frame member 46.

Also included in carriage 180R is a horizontally disposed front spool 184R rotatably mounted on a horizontal axle 185R held at opposite ends by inner and outer brackets 186 and 187 extending forward from the inner and outer side walls, respectively, of U-shaped channel 181R. Carriage 180L is constructed identically to carriage 180R, having corresponding parts 181L–187L, respectively.

In performing the leg press exercise shown in FIG. 13, the free ends of cables 127R and 127L are attached to eyebolts 188R and 188L fastened to bottoms of carriages 180R and 180L, respectively.

In performing a leg press exercise as illustrated in FIG. 13, the leg exercise attachment 96 may be removed from the machine 30. The person performing the exercise then reclines on back rest section 54 of bench section 50, and pushes upwards with his feet on foot plates 189R and 189L fastened to the underside of foot bar 179. Upward motion of foot bar 179 is resisted by the force of gravity on weight trucks 114R and 114L, which are connected to the foot bar via cables 127R and 127L, respectively. Weight trucks 114R and 114L may be fitted with a desired number of weights 122R and 122L to provide a desired resistance force to the upward movement of foot bar 179.

FIG. 14 illustrates how a person in a wheelchair may effectively use exercise machine 30 to perform exercises while seated in the wheelchair. For the exercise shown in FIG. 14, the bench section 50 is removed from the machine 30. This permits a wheelchair and its occupant to roll into the interior of the machine 30 through its open rear end. Thus positioned within the machine 30, the seated occupant of the wheelchair may perform seated cross-over fly exercises similar to the standing cross-over fly exercise illustrated in FIG. 7 and described above. The configurations of cables, pulleys and weights for the seated cross-over fly exercise is identical to that described above for the standing cross-over fly exercise. Therefore, a description of that configuration need not be repeated.

Figure 15:
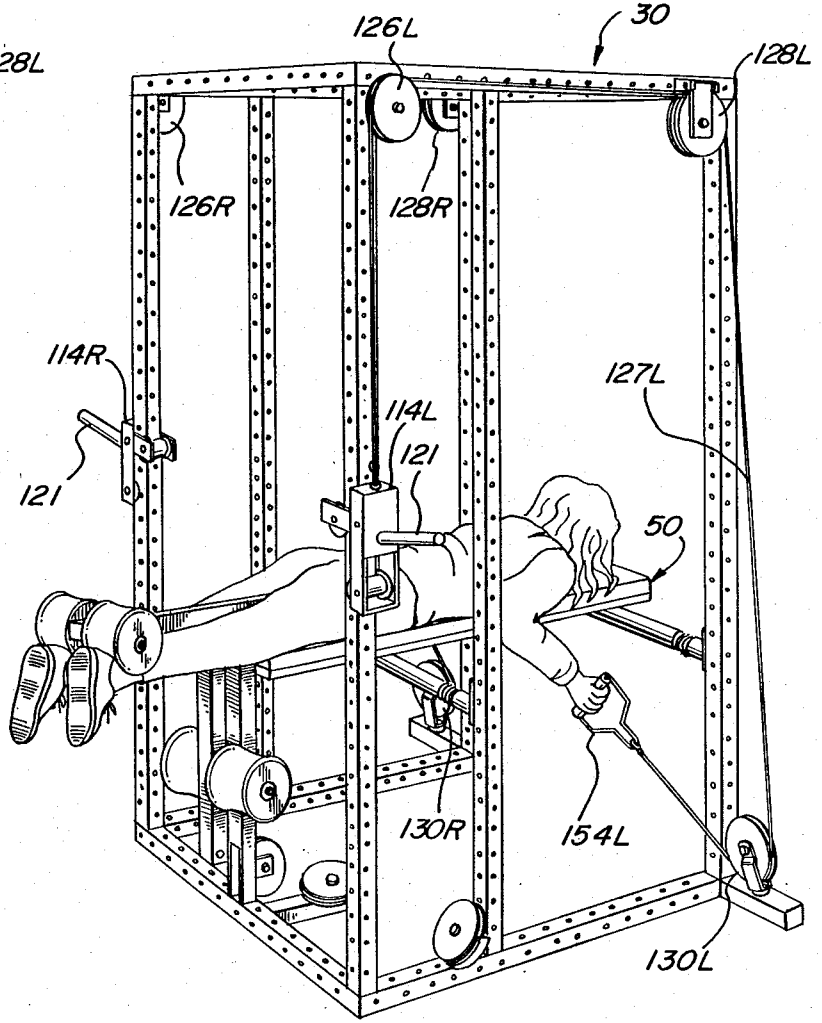
FIG. 15 is a side perspective view of the machine of FIG. 1 in an eighth configuration, showing a person performing a reclining rowing exercise.

FIG. 15 illustrates a configuration of machine 30 in which a person may perform a reclining rowing exercise. The configuration of machine 30 for this exercise is substantially identical to the configuration used for reclining cross-over fly exercises as illustrated in FIG. 8 and described above. However, cables 127R and 127L may be shorter for the reclining rowing exercise. Also, for the reclining rowing exercise, the exerciser lies on his or her stomach, rather than on the back.

Figure 16:
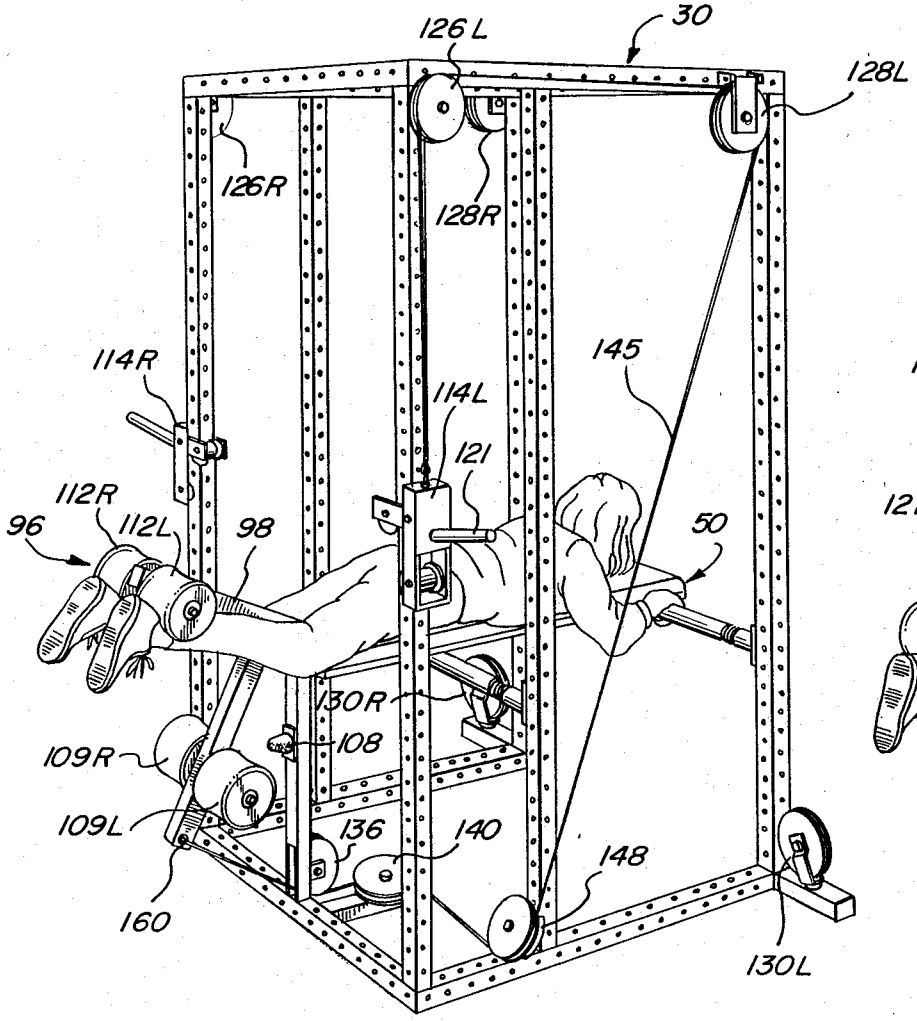
FIG. 16 is an oblique side perspective view of the machine of FIG. 1 in a ninth configuration, showing a person performing a reclining leg flexion exercise.

FIG. 16 shows a person performing a reclining leg flexion exercise using machine 30. For this exercise, the machine is configured the same as for the leg extension exercise, as shown in FIGS. 9 and 10 and described above. However, for this exercise, the exerciser lies on his or her stomach, as shown in FIG. 16, rather than on the back.

The various configurations of machine 30 and the exercises performable with the machine and described above represent just a sample of the many different configurations and exercises made possible by the novel and versatile design of the machine. Part of the versatility of the machine stems from the novel combination of swiveling pulleys. For example, a person may exercise the biceps of just one arm by standing outside of machine 30, left of lower left swiveling pulley 130, with the machine configured as shown in FIG. 8. The person may then grasp handgrip 154L and pull upward on the handgrip against the force of gravity on weight truck 114L.

What is claimed is:

1. An exercise machine comprising:

a. a vertically elongated open, box-like structure having a generally rectangular transverse cross-sectional shape and of sufficient height to stand upright within the interior space of said structure, said structure having a horizontally disposed rectangular roof frame, a plurality of vertically disposed columnar members, one each attached to and extending downwards from each corner of said roof frame, said columnar members constituting right and left front vertical frame members and right and left rear vertical frame members, and two intermediate vertical columnar members, one each rearward of and parallel to said right and left front vertical frame members, respectively, b. at least one reaction force producing means fastened to said structure, c. at least one pulley mounted near the upper portion of said structure, d. a cable extending vertically upwards over and around the sheave of said pulley, said cable being fastened at one end to the free end of said reaction force producing means, said cable being graspable at its other end and pullable against the reaction force of said reaction force producing means, and e. a bench section, said bench section comprising, (i) a generally flat front seat section having a generally square plan view, said front seat section having attached to its underside an elongated, laterally disposed tubular support member, said tubular support member having at opposite lateral ends means for adjustably fastening at a selected height to an intermediate vertical frame member, and supporting said end of tubular member, thereby supporting said front seat section at a desired height, and (ii) a generally flat back rest section having a longitudinally elongated, generally rectangular plan view, said back rest section being hingedly joined at its front lateral edge to the rear lateral edge of said front seat section, and said back rest section having attached to its underside an elongated, laterally disposed tubular support member having at opposite lateral ends means for adjustably fastening at a selected height to a rear vertical frame member and supporting said back rest section at a desired height independently of the height of said front seat section.

2. An exercise machine comprising:

a. a vertically elongated open box-like structure having a generally rectangular transverse cross-sectional shape and of sufficient height to permit an average individual to stand upright within the interior space of said structure, said structure having a horizontally disposed rectangular roof frame, a plurality of vertically disposed columnar members, one each attached to and extending downwards from each corner of said roof frame, said columnar members constituting right and left front vertical frame members and right and left rear vertical frame members, each of said vertical frame members having a plurality of through-holes extending through said frame member disposed at regular intervals, and two intermediate vertical columnar members, one each rearward of and parallel to aid right and left front vertical frame members, respectively, each of said intermediate vertical columnar members having a plurality of through-holes extending through said frame member disposed at regular longitudinal intervals, b. at least one reaction force producing means fastened to said structure, c. at least one pulley mounted near the upper portion of said structure, d. a cable extending vertically upwards over and around the sheave of said pulley, said cable being fastened at one end to the free end of said reaction force producing means, said cable being graspable at its other end and pullable against the reaction force of said reaction force producing means, and e. a bench section, said bench section comprising (i) a generally flat front seat section having a generally square plan view, said front seat section having attached to its underside an elongated, laterally disposed tubular support member, said tubular support member having at opposite lateral ends means for engaging a selected one of said plurality of holes in an intermediate vertical frame member, and supporting said end of tubular member, thereby supporting said front seat section at a desired height, and (ii) a generally flat back rest section having a longitudinally elongated, generally rectangular plan view, said back est section being hingedly joined at its front lateral edge to the rear lateral edge of said front seat section, and said back rest section having attached to its underside an elongated, laterally disposed tubular support member having at opposite lateral ends means for engaging a selected one of said plurality of holes in a rear vertical frame member and supporting said back rest section at a desired height, independently of the height of said front seat section.

3. The exercise machine of claim 2 wherein said base frame is further defined as comprising an elongated straight front member and two equal length, parallel side members joined perpendicularly to the outer lateral ends of said front member and extending backwards therefrom, thereby forming a U-shaped structure adapted to lie flat on a horizontal floor surface, the open space between the rear ends of the side members permitting a wheelchair to be rolled into the interior space of said frame.

4. The exercise machine of claim 2 further including a exercise attachment, said leg exercise attachment comprising:

a. an elongated upper horizontal beam member, b. an elongated vertical column member, said column member extending perpendicularly downwards from the lower surface of said horizontal beam member, the rear vertical surface of said column member being located some distance inwards from the rear transverse surface of said beam member, c. a pair of generally cylindrical cushions extending colinearly outwards from opposite lateral sides of said horizontal beam member near its front transverse face, said being adapted to be engaged by feet, d. a pair of generally cylindrical cushions extending colinearly outwards from opposite lateral sides of said vertical column member near its bottom transverse face, said cushions being adapted to be engaged by feet, e. means for pivotably fastening the rear end of said horizontal beam member to said frame, thereby permitting pivoting motion in a vertical plane of said leg exercise attachment, and f. means for coupling the lower end of said column member to movement resisting means.

5. The exercise machine of claim 4 further including means for resiliently limiting downward movement of said vertical column member of said leg exercise attachment.

6. The exercise machine of claim 4 wherein said means for pivotably fastening the rear end of said horizontal beam member of said leg exercise attachment to said frame comprises in combination an elongated vertical support column extending perpendicularly upwards from said front member of said base frame, and a laterally disposed, elongated pivot member extending laterally through registered holes in said vertical support column member near its upper transverse face, and in said upper horizontal beam member, near its rear transverse face.

7. The exercise machine of claim 6 further including an elongated resilient member projecting forward from said vertical support column member, for resiliently limiting downward pivotal motion of said vertical column member of said leg exercise attachment relative to said vertical support column member.

8. The exercise machine of claim 2 further including at least one weight truck for holding a selectable number of weights, said weight truck being vertically slidably mounted on one of said front vertical columnar frame members.

9. An exercise machine comprising a vertically elongated open box-like structure having a generally rectangular transverse cross-sectional shape and of sufficient height to permit an average individual to stand upright within the interior space of said frame, said structure comprising;

a. a framework comprising, (i) a horizontally disposed generally rectangular base frame, (ii) a pair of vertically disposed columnar front vertical frame members, one each attached to and extending upwards from opposite front corners of said base frame, (iii) a pair of vertically disposed columnar rear vertical frame members, one each attached to and extending upwards from opposite rear corners of said base frame, (iv) a pair of vertically disposed columnar intermediate vertical frame members, one each attached to and extending upwards from opposite side members of said base frame, at a longitudinal position intermediate said front and rear vertical frame members, and (v) a horizontally disposed rectangular roof frame overlying said base frame, b. a first weight truck for holding weight members of selectable total weight vertically movable on one of said front vertical frame members, c. a first pulley fastened to said frame of said machine near the junction of the front member of said rectangular roof frame with said vertical frame member on which said weight truck is vertically movable, d. a cable extending vertically upwards over and around the sheave of said first pulley, said cable being fastened at one end to an upper end of said weight truck, said cable being graspable at its other end and pullable against the resistance force of gravity on said weight truck, e. a second pulley fastened to said frame of said machine near the junction of the rear member of said rectangular roof frame with said rear vertical frame member on that side of said frame on which said weight truck is located, said second pulley being so fastened to said frame as to permit said pulley to swivel in a vertical plane about a horizontal axis, f. a third pulley fastened to said frame of said machine near the junction of the base frame of said machine with said rear vertical frame member on that side of said frame on which said weight truck is located, said third pulley being so fastened to said base frame as to permit said pulley to swivel about a vertical axis, g. an elongated outrigger member extending laterally outwards from the junction of said rear vertical frame member with said base frame, said third pulley being mounted to said outrigger member near the outer lateral end of said outrigger member, and h. a leg exercise attachment pivotably fastenable to the front portion of said base frame in a manner permitting pivotable motion in a vertical plane of said leg exercise attachment.

10. The exercise machine of claim 9 further including means for providing a selectable resistance force to said vertically pivotable motion of said leg exercise attachment.

11. The exercise machine of claim 10 wherein said means for providing a selectable resistance force to said vertically pivotable motion of said leg exercise attachment comprises in combination;

a. a fourth pulley vertically oriented and disposed below said leg exercise attachment, b. a fifth pulley horizontally oriented and disposed below and slightly laterally offset from said fourth type pulley, c. a sixth pulley diagonally oriented and disposed laterally outward of said fifth pulley, and d. a cable fastened to said leg exercise attachment near the lower end of said leg exercise attachment, said cable extending downward in said vertically oriented sheave of said fourth pulley, horizontally outward in said horizontally oriented sheave of said fifth pulley to said sixth pulley, diagonally upward and rearward around the diagonally oriented sheave of said sixth to that second pulley fastened near the junction of said rectangular roof frame with that rear vertical frame member on the same side of said frame as said sixth, diagonal pulley, vertically upward and horizontally forward around the vertical oriented sheave of said second pulley to said first pulley on the same side of said frame as said second pulley to said weight truck, whereby upward movement of said lower end of said leg exercise attachment produces tension and displacement of said cable causing upward motion of said weight truck against the resisting force of gravity.

12. The exercise attachment of claim 9 further including a leg press exercise attachment, said leg press exercise attachment comprising in combination:

a. a laterally elongated footbar, b. fastening means at opposite lateral ends of said bar operatively connected to opposite intermediate vertical frame members so as to permit vertical movement in unison of opposite lateral ends of said footbar, said footbar remaining in fixed fore and aft and lateral relationship to said frame.

* * * * *